US005113112A

United States Patent [19]

Shimoma et al.

[11] Patent Number: 5,113,112

[45] Date of Patent: May 12, 1992

[54] COLOR CATHODE RAY TUBE APPARATUS

[75] Inventors: Taketoshi Shimoma, Isesaki; Eiji Kamohara; Jiro Shimokobe, both of Fukaya, all of Japan

[73] Assignee: Kabushiki Kaisha Toshiba, Kawasaki, Japan

[21] Appl. No.: 603,326

[22] Filed: Oct. 25, 1990

[30] Foreign Application Priority Data

Oct. 25, 1989 [JP] Japan ..... 1-275952

[51] Int. Cl.[5] ..... H01J 29/51; H01J 29/62

[52] U.S. Cl. ..... 313/412; 313/413; 313/414; 313/428

[58] Field of Search ..... 313/412, 413, 414, 428

[56] References Cited

U.S. PATENT DOCUMENTS 2,160,021 5/1939 Iams ..... 315/16
4,142,131 2/1979 Ando et al. ..... 313/414 X
4,443,736 4/1984 Chen ..... 313/414
4,678,964 7/1987 Peels ..... 313/414

FOREIGN PATENT DOCUMENTS 58-32455 7/1983 Japan .

*Primary Examiner*—Donald J. Yusko
*Assistant Examiner*—Ashok Patel
*Attorney, Agent, or Firm*—Cushman, Darby & Cushman

[57] ABSTRACT

In a color cathode ray tube apparatus of this invention, an electron beam forming unit of an electron gun outputs electron beams to have an interval of 3.5 to 6.0 mm between adjacent beams, and a ratio of a neck inner diameter to the interval between the adjacent electron beams is 5.1 or more. The main lens unit of the electron gun has a large-aperture electron lens formed by a substantially cylindrical first electrode for allowing three electron beams to pass therethrough, and a substantially cylindrical second electrode in which most of the first electrode is arranged.

8 Claims, 16 Drawing Sheets

COLOR CATHODE RAY TUBE APPARATUS

BACKGROUND OF THE INVENTION

1. Field of the Invention

The present invention relates to a color cathode ray tube apparatus and, more particularly, to a general color cathode ray tube having high image quality such as an EDTV or HDTV.

2. Description of the Related Art

A general color cathode ray tube apparatus having high image quality comprises a tube provided with a panel, a funnel contiguous with the panel, and a cylindrical neck connected to the funnel. A shadow mask is arranged inside the panel, and a phosphor screen surface comprising a tri-color light emitting layer is formed on the inner surface of the panel to oppose the shadow mask. A large number of apertures are formed in the shadow mask. The shadow mask has a frame on its periphery, and is supported on the panel through the frame. An internal magnetic shield is mounted on the frame. An internal conductive film is coated from the inner wall of the funnel to a portion of the neck. An external conductive film is coated on the outer wall of the funnel, and an anode electrode is provided to a portion of the funnel. An electron gun for outputting three electron beams is accommodated in the neck. A deflection device is arranged outside a boundary portion between a cone portion of the funnel and the neck so as to deflect three electron beams emerging from the electron gun in horizontal and vertical directions. In addition, a driver for applying an appropriate voltage to the electron gun and the anode electrode and supplying a voltage to the deflection device is arranged.

Red, green, and blue phosphor stripes or dots are distributed and coated on the phosphor screen surface. Three electron beams Br, Bg, and Bb emerging from the electron gun toward the phosphor screen surface are deflected by the deflection device. The electron beams Br, Bg, and Bb are selected by the shadow mask, and then become incident on the phosphor screen. Thus, the corresponding phosphors emit light to form an image. In an electron gun having an in-line arrangement, three parallel electron beams are generated. This electron gun has an electron beam forming unit GE for generating, controlling, and accelerating three electron beams, and a main electron lens unit ML for focusing and converging these electron beams.

A deflection yoke as the deflection device has horizontal and vertical deflection coils for deflecting the three electron beams in the horizontal and vertical directions. In the deflection yoke for deflecting inline aligned electron beams, in order to precisely converge electron beams, a horizontal deflection magnetic field is formed into a pin-cushion pattern, and a vertical deflection magnetic field is formed into a barrel pattern, thus constituting a so-called convergence free system.

A general color image pickup tube is required to have a small depth, low power consumption, and high resolution over the entire screen. However, these requirements confront technical limitations, and pose very difficult problems. These problems will be briefly summarized below.

(1) Small Depth Requirement

In order to realize this, a deflection angle of electron beams is increased. However, when the deflection angle of the electron beams is increased, a deflection current is increased, and power consumption is also increased.

Furthermore, deflection defocusing and a difference between moving distances of electron beams are increased, thus impairing both convergence and focusing.

(2) Low Power Consumption Requirement

In order to achieve this, a neck diameter can be decreased to increase a deflection sensitivity, and a deflection angle can be decreased. However, when the neck diameter is decreased, focusing is impaired to decrease a resolution. Furthermore, when the deflection angle is decreased, this inevitably leads to an increase in depth.

(3) High Resolution Requirement Over Entire Surface

In order to achieve this, a deflection angle can be decreased, and a correction coil and a digital convergence circuit can be added. However, when the deflection angle is decreased, this inevitably causes an increase in depth. Furthermore, new circuits, in particular, the digital convergence circuit requires large power consumption, thus increasing power consumption as a whole.

The above-mentioned problems will be described in detail below.

In order to decrease a depth of a deflection of electron beam, a maximum deflection angle of electron beams deflected by the deflection yoke can be increased. However, when the deflection angle is increased, a deflection current flowing through the deflection coils is increased, resulting in an increase in power consumption. In order to reduce power consumption, the neck diameter can be decreased to increase a deflection sensitivity. However, when the neck diameter is decreased, the aperture of an electron lens of the electron gun is inevitably decreased, and two side electron beams tend to be easily influenced by an aberration of the electron lens, thus increasing a beam spot size on the screen. As a result, resolution is decreased. Furthermore, in the problem of power consumption, an electrical power supplied to the horizontal deflection coil particularly poses a problem. This problem is posed in the NTSC method since a horizontal deflection frequency (15,750 Hz) is much higher than a vertical deflection frequency (60 Hz) (i.e., about 260 times). When an impedance of the horizontal deflection coil is represented by $L_H$ (mH), and a current is represented by i'' (A), power consumption is expressed by $L_H \cdot (i_H^2)$ mH·(A$^2$). When power consumption is large, this poses not only an economic problem but also a fatal problem such that the deflection yoke is heated and burnt. The critical temperature of the deflection yoke is 60° C. according to its constituting material.

When the deflection angle is increased, another problem is posed. That is, when the deflection angle is large, a difference between flying distances of electron beams on the central portion and the peripheral portion of the screen becomes very large, resulting in poor focusing of electron beams by the electron gun. Furthermore, since deflection defocusing caused by the deflection yoke is increased, resolution is considerably decreased on the peripheral portion of the screen. In order to decrease the spot size on the screen, the neck diameter must be increased to increase the electron lens aperture of the electron gun. However, since three electron lenses are linearly aligned, the diameter of the electron gun is increased. Thus, a deflection sensitivity is impaired, and it is difficult to attain good convergence of the three electron beams on the entire screen. As a result, resolution and sharpness are impaired.

A home color cathode ray tube will be exemplified below. For example, a screen diagonal dimension is 32"; a deflection angle, 110°; a depth, about 500 mm; a neck inner diameter, 26.0 mm; a neck outer diameter, 32.5 mm; a lens aperture (beam passage hole diameter) of an electron gun, 6.2 mm; an interval of in-line aligned three electron beams, 6.6 mm; a length of the deflection yoke along the tube axis, 75 mm; an opening on the electron gun side of the yoke, 35 mm; and an opening on the screen side of the yoke, about 140 mm. The deflection yoke has saddle-type horizontal and vertical deflection coils each of which is formed by winding a single wire. A spot size of the electron beams on the screen is about 2 mm when the current value of the electron gun is 1 mA. A consumption current $L_H \cdot (i_H^2)$ of the coil is about 42 mH·($A^2$) (anode voltage = 32 kV). When deflection is performed at a horizontal deflection frequency of 15.75 kHz and a vertical deflection frequency of 60 Hz, heat generation is about 35° C. In addition, convergence quality is about 2.0 mm on the peripheral portion of the screen.

A color cathode ray tube used in a television system such as an EDTV or HDTV is required to have higher image quality than the above-mentioned cathode ray tube. However, if quality is improved in a video signal system, various problems of the color cathode ray tube as a whole are posed, and it is very difficult to improve image quality.

Since the HDTV is required to have very high quality, various color cathode ray tube apparatuses have been manufactured as samples. However, these apparatuses are very disadvantageous as home color cathode ray tubes as follows.

For example, in a color cathode ray tube apparatus having a screen diagonal dimension of 32", a deflection angle of electron beams is 90°, and a depth of the tube is about 660 mm. Thus, the depth is larger than a conventional tube apparatus by 160 mm. For this reason, such a tube apparatus is too large for a home use, resulting in large industrial and economic losses.

In this tube, the neck has an inner diameter of 30.9 mm and an outer diameter of 36.6 to 37.5 mm. Three electron beams of the electron gun are delta-aligned, and the aperture of one electron lens (beam passage hole diameter) is 12.0 mm. The aperture of one electron lens is about twice that of a general home tube apparatus. Since a resolution of 1,000 (TV) lines is required, a beam spot size on the screen is about 1.2 mm (electron gun current value Ik = 1 mA), i.e., decreased by about 40% as compared to that of the home tube apparatus. When the electron lens aperture is increased, the spot size of the electron beams is decreased accordingly. Therefore, when the electron lens becomes large in size, the spot size on the screen can be decreased. That is, when the lens aperture is determined, an electron optical magnification is determined. The same applies to other types of electron lens (e.g., bipotential type, unipotential type). In this apparatus in the HDTV required to have a resolution as high as 1,000 (TV) lines, a lens aperture of about 12 mm or more is required. However, when three electron beams are inline aligned in an electron gun having a neck inner diameter of 30.9 mm, the aperture of one lens is a maximum of 9 mm, and it is impossible to increase the aperture to 12 mm or more. Since three electron beams are delta-aligned, good convergence cannot be obtained over the entire screen by the above-mentioned convergence free magnetic field distribution. Therefore, a new convergence correction coil must be added, resulting in large industrial and economic losses, and an expensive color cathode ray tube apparatus.

Furthermore, the HDTV is required to have a maximum miss-convergence amount of 0.3 to 0.5 mm (about 0.1% or less of a screen height). However, such high-precision convergence cannot be obtained by only the above-mentioned correction coil. For this reason, a digital convergence circuit is added. Since this digital convergence circuit is expensive and requires a high electrical power, it is not suitable for a home use. If convergence is set using the digital convergence circuit, it must be set and stored at several tens of positions on the entire screen one by one. For this reason, much time is required in the manufacture. Therefore, the digital convergence circuit cannot be used in general color cathode ray tube apparatuses which must be mass-produced. In addition, industrial and economic losses are large, and cost becomes several to several tens of times that of existing home color cathode ray tube apparatuses.

Power consumption $L_H \cdot (i_H^2)$ of the deflection yoke for deflecting electron beams through 90° by generating identical magnetic fields from its saddle-type horizontal and vertical deflection coils is about 35 mH·($A^2$) and is lower than that required when beams are deflected through 110°. Therefore, no heat problem caused by heat generation occurs. However, when the deflection angle of electron beams is increased to be larger than 90°, power consumption is abruptly increased, and a problem of heat generation is posed accordingly. In addition, convergence is impaired. When the electron beams are deflected through a wide angle of 100° or more, a spot of the electron beams causes a considerable halo on the peripheral portion of the screen due to deflection defocusing by the deflection yoke. As a result, resolution is considerably decreased. The above-mentioned delta-aligned electron gun cannot improve such deflection defocusing as a dynamic focus.

As described above, a television system is required to provide a high-quality image. However, a color cathode ray tube apparatus having a high-quality image poses problems of a large tube depth, high power consumption, and very high cost.

SUMMARY OF THE INVENTION

It is an object of the present invention to provide a color cathode ray tube apparatus used in a high-quality image television system, which has a small depth, lower power consumption, very high practicability, and high industrial and economic merits as in a conventional home color cathode ray tube.

A color cathode ray tube apparatus according to the present invention comprises an envelope having a panel, a funnel, and a neck, a screen formed on an inner surface of the panel, an electron gun, accommodated in the neck, for outputting a plurality of electron beams, and deflection means, arranged to extend over the neck to the outer surface of the funnel, for deflecting the electron beams emerging from the electron gu in horizontal and vertical directions. In this color cathode ray tube apparatus, the deflection means comprises at least saddle-type horizontal and vertical deflection coils. The electron beams are defected by the deflection means to have a maximum diagonal deflection angle of 100° or more. The electron gun at east comprises an electron beam forming unit having three cathodes, and a main electron lens unit for focusing and converging these electron beams. The electron beam forming unit outputs adjacent electron beams at an interval of 3.5 to 6.0 mm. A ratio of the inner diameter of the neck to the interval between the adjacent electron beams is 5.1 or more. The main lens unit comprises a large-aperture electron lens formed by a substantially cylindrical first electrode for allowing three electron beams to pass therethrough, and a substantially cylindrical second electrode in which most of the first electrode is arranged.

Although the color cathode ray tube apparatus according to the present invention has a small depth since the deflection angle of the electron beams is as wide as 100° to 110°, it has a large-diameter neck, and a small interval among the three electron beams, thus eliminating deflection defocusing. Since no digital convergence circuit is used, power consumption can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of the present invention will be described below with reference to the accompanying drawings.

Figure 1:
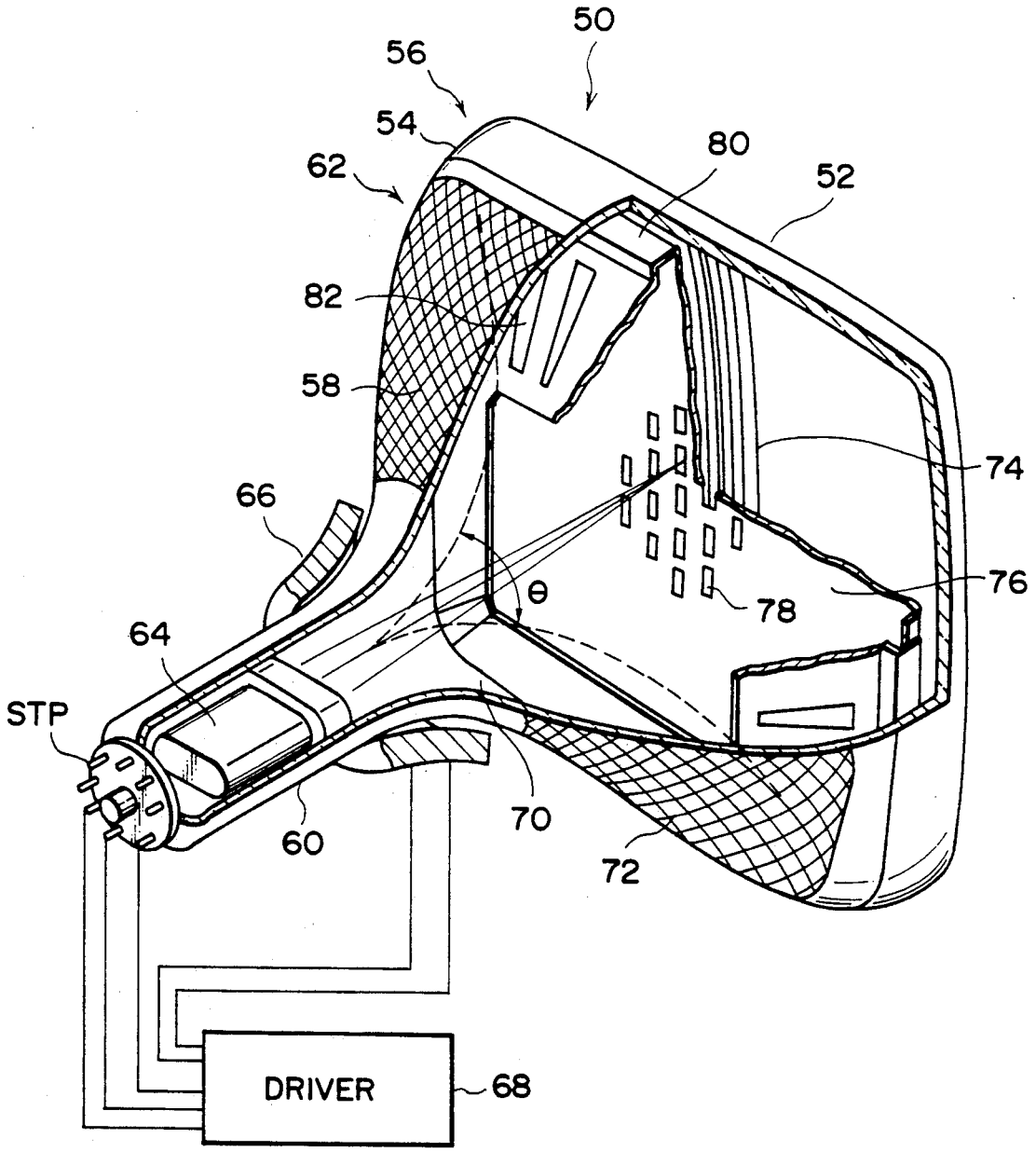
FIG. 1 is a partially cutaway perspective view showing a color cathode ray tube apparatus according to an embodiment of the present invention.

FIG. 1 shows a color cathode ray tube apparatus according to the first embodiment of the present invention. A color cathode ray tube apparatus 50 comprises an envelope 62 which includes a panel section 56 having a substantially rectangular face plate 52 and a skirt 54 extending from a side edge portion of the face plate, a funnel section 58 joined to the panel section 56, and a neck section 60 contiguous with the funnel section. The panel section 56, the funnel section 58, and the neck section 60 maintain a vacuum state of the interior of a tube. An internal conductive film 70 is coated on the inner wall of the funnel section 58, and a portion of the inner wall of the neck section 60 contiguous with the funnel section. An external conductive film 72 is coated on the outer wall of the funnel section 58, and an anode terminal (not shown) is connected thereto. An electron gun assembly 64 for generating three electron beams $B_R$, $B_G$, and $B_B$ is accommodated in the neck section 60. A deflection device 66 having a horizontal deflection coil for generating a magnetic field to deflect the electron beams $B_R$, $B_G$, and $B_B$ in the horizontal direction, and a vertical deflection coil for generating a magnetic field to deflect the beams in the vertical direction is arranged on the outer surfaces of the funnel section 58 and the neck section 60. In order to drive the deflection device 66 and the electron gun assembly 64, a driver 68 for applying an appropriate voltage to the anode terminal connected to the deflection device 66 and stem pins STP connected to the electron gun assembly 64 is connected.

A phosphor screen 74 is formed on the inner surface of the face plate 52 of the panel section 56. A substantially rectangular shadow mask 7 is arranged in the tube to oppose the phosphor screen 74 and to be spaced apart from the face plate 52 by a predetermined interval. The shadow mask 76 is formed of a thin metal plate, and has a large number of apertures 78. A mask frame 80 for supporting the shadow mask 76 is arranged around the shadow mask 76. The mask frame 80 is supported on the panel section 56 through a plurality of elastic support members (not shown). An internal magnetic shield 82 is arranged on the mask frame 80.

Figure 2:
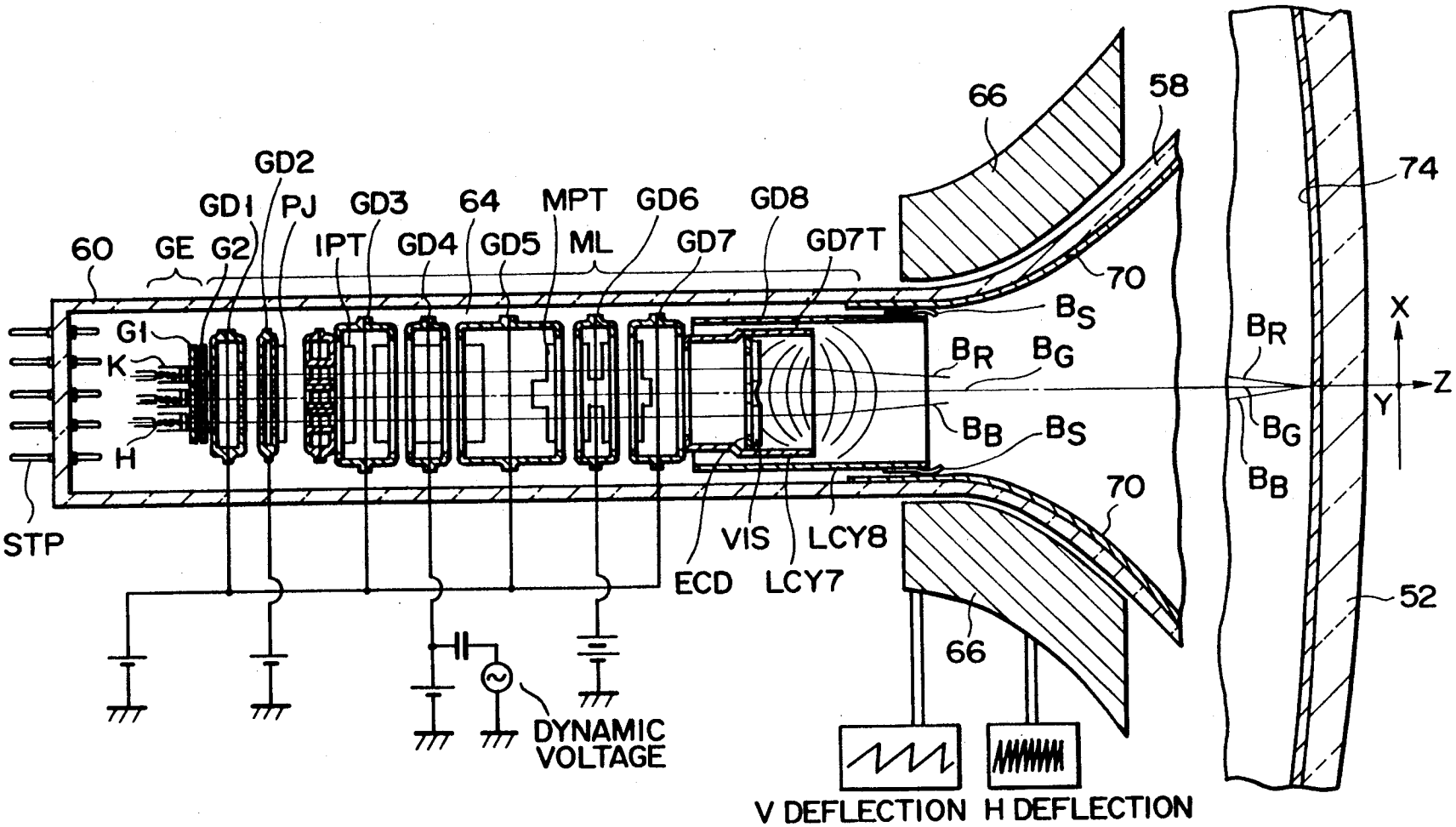
FIG. 2 is an enlarged sectional view taken along an X-Z direction of a portion of the apparatus near an electron gun shown in FIG. 1.
Figure 3:
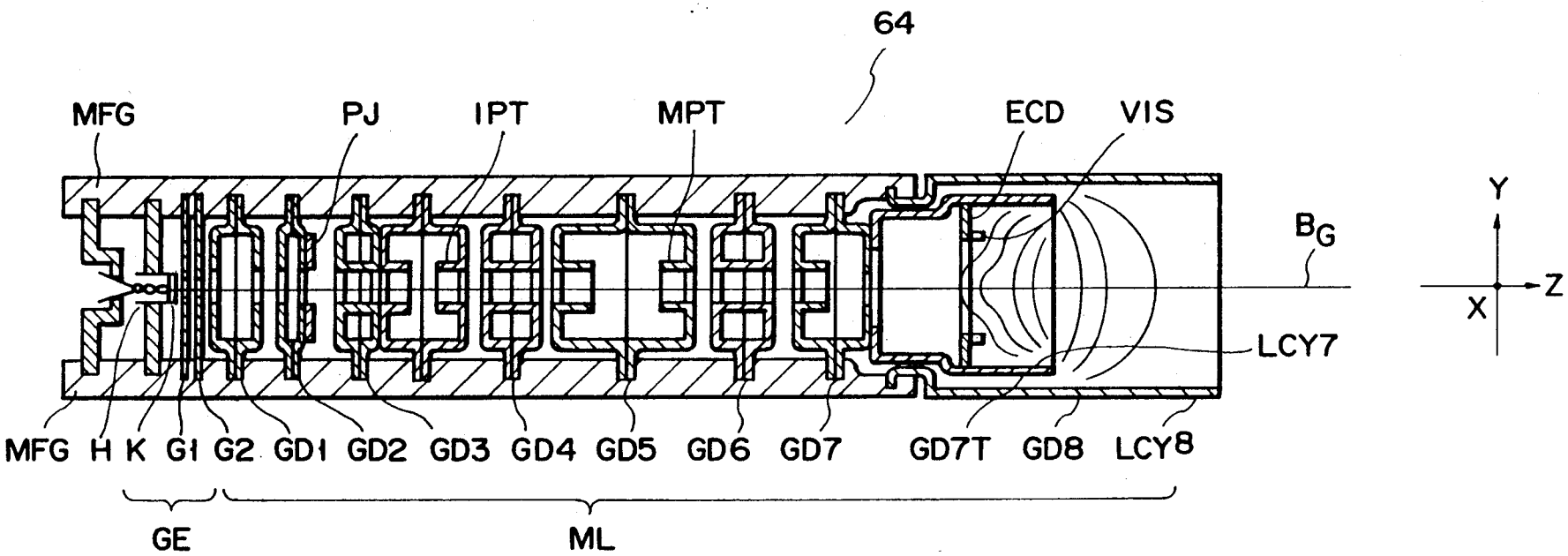
FIG. 3 is an enlarged sectional view taken along a Y-Z direction of the portion of the apparatus near the electron gun shown in FIG. 1.

FIGS. 2 and 3 show the electron gun assembly 64 accommodated in the neck 60. The electron gun assembly 64 comprises an electron beam forming unit GE having cathodes K, a control grid $G_1$, and a screen grid $G_2$, a main lens unit ML having first, second, third, fourth, fifth, sixth, seventh, and eighth grids respectively $GD_1$, $GD_2$, $GD_3$, $GD_4$, $GD_5$, $GD_6$, $GD_7$, and $GD_8$, an insulating support member MFG for supporting the electron beam forming unit GE and the main lens unit ML, and a bulb spacer $B_S$. The electron gun assembly 64 is fixed by the stem pins STP.

The electron beam forming unit GE of the electron gun assembly 64 is formed as follows. The cathodes K include three heaters H. Relatively small beam passage holes are formed in the control grid $G_1$ and the screen grid $G_2$. A cathode K side electrode of the first grid $GD_1$ serves as a beam forming unit, and three beam passage holes larger than that of the screen grid $G_2$ are formed in its electrode.

In this electron beam forming unit GE, three electron beams $B_R$, $B_G$, and $B_B$ are generated from the heaters H of the cathodes K. The electron beams $B_R$, $B_G$, and $B_B$ are controlled and accelerated when they pass through the three relatively small beam passage holes of the control grid $G_1$ and the screen grid $G_2$, and the three beam passage holes in the cathode K side electrode of the first grid $GD_1$.

Figure 4:
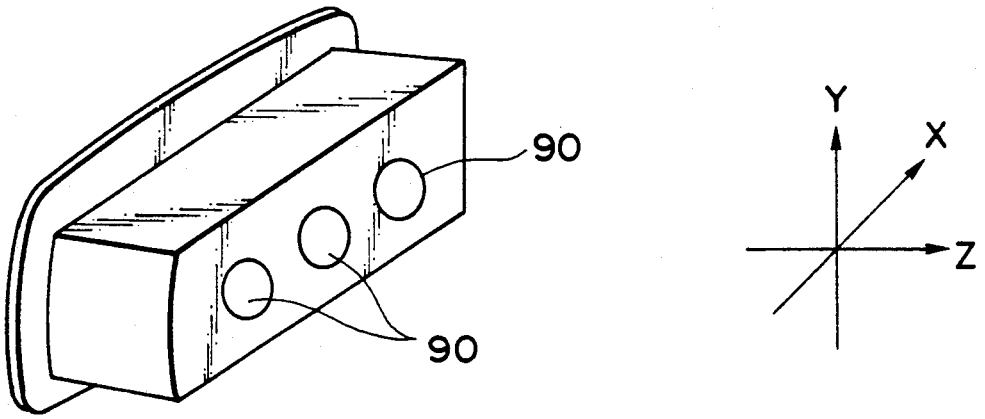
FIG. 4 is a perspective view of an electrode used in the electron gun according to the present invention.
Figure 5:
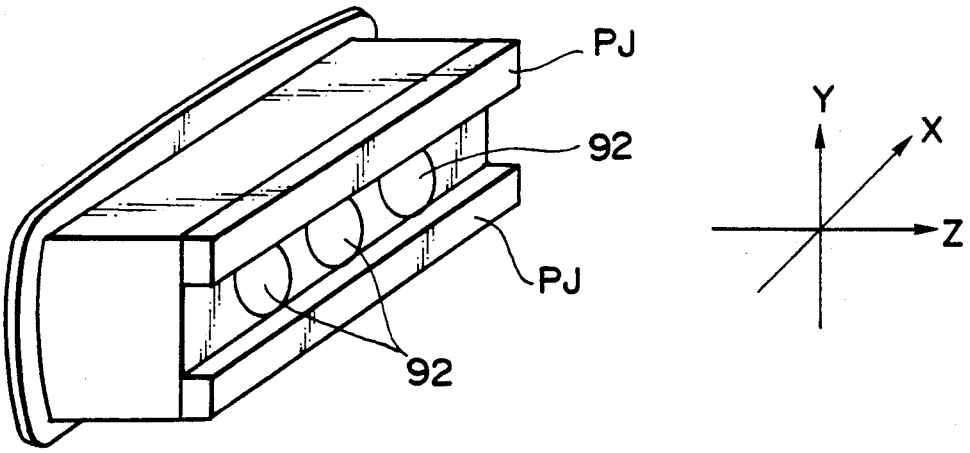
FIG. 5 is a perspective view of another electrode used in the electron gun according to the present invention.
Figure 6A:
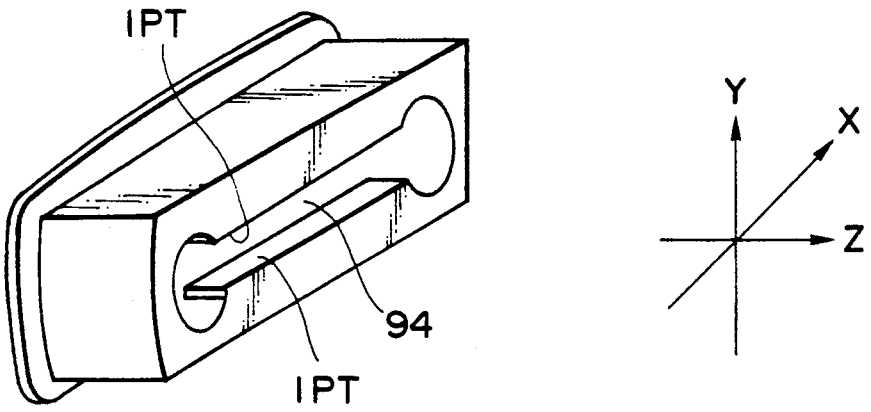
FIGS. 6A and 6B are perspective views showing other electrodes used in the electron gun according to the present invention.
Figure 6B:
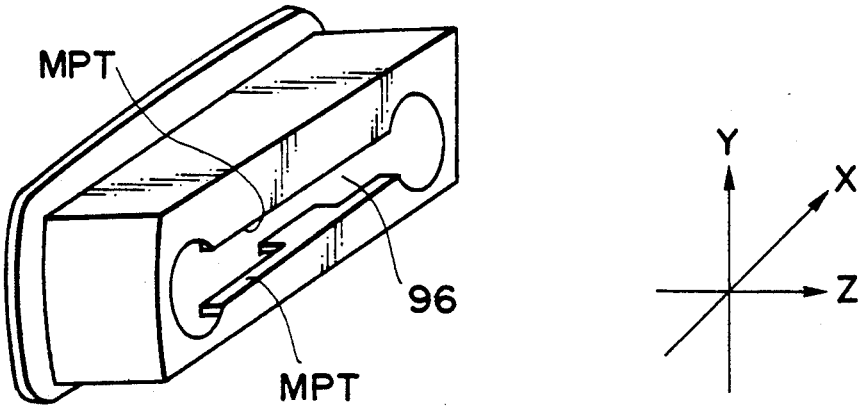
Figure 7A:
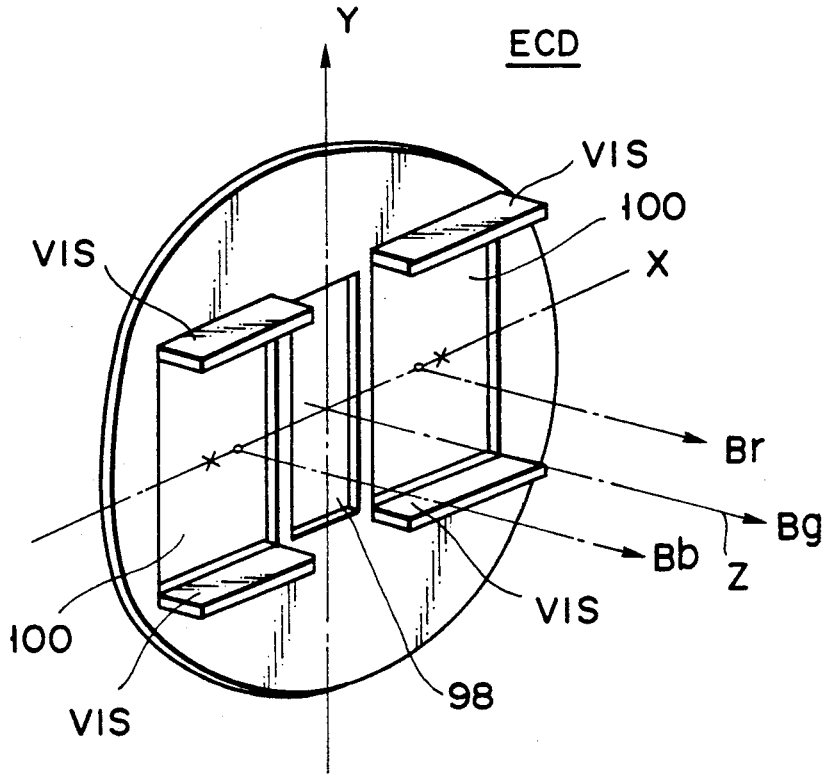
FIG. 7A is a perspective view showing still another electrode used in the electron gun according to the present invention.
Figure 7B:
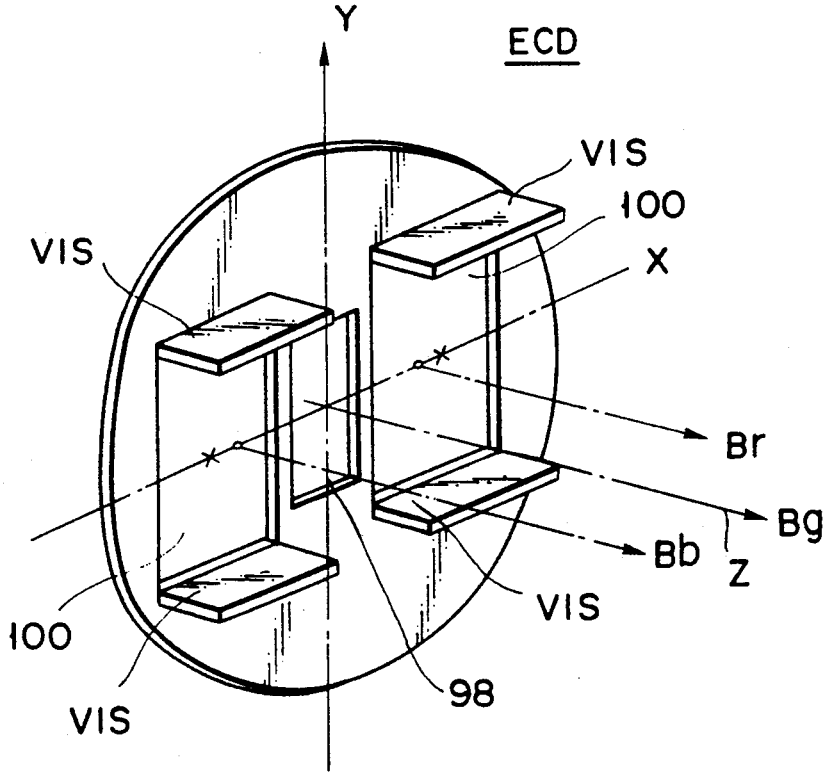
FIG. 7B is a perspective view showing a modification of the embodiment shown in FIG. 7A.

The main lens unit ML of the electron gun assembly 64 is formed as follows. Larger beam passage holes 90 corresponding to the three beam passage holes of the cathodes K are formed in a second-grid side electrode of the first grid $GD_1$, the second grid $GD_2$, and a second-grid side electrode of the third grid $GD_3$, as shown in FIG. 4. Parallel projections PJ are formed on two sides of three beam passage holes 92 on the third grid side of the second grid $GD_2$, as shown in FIG. 5. A beam passage hole 94 which is elongated in the X direction is formed in a fourth-grid side electrode of the third grid $GD_3$, the fourth grid $GD_4$, the fifth grid $GD_5$, the sixth grid $GD_6$, and a sixth-grid side electrode of the seventh grid $GD_7$, as shown in FIG. 6A. Two opposing projections IPT which project in a direction of an X-Z plane along an alignment direction of beams are formed on a portion around the beam passage hole 94 on two sides of the beams. In particular, in the fifth grid $GD_5$, the sixth grid $GD_6$, and the sixth-grid side electrode of the seventh grid $GD_7$,these projections IPT are formed as projections MPT each having a shape in which portions near two side beams near the peripheral portions of a hole 96 are shorter than a portion near the central beam, as shown in FIG. 6B. An eighth-grid side electrode of the seventh grid $GD_7$ is formed as a cylinder LCY7 inserted in the eighth grid $GD_8$. A planar electrode ECD shown in FIG. 7A is provided on the eighth grid side of the cylinder LCY7. One central beam passage hole 98 and two side beam passage holes 100 are formed in the planar electrode ECD. Pairs of opposing projections VIS projecting toward the eighth grid along the alignment direction of the three electron beams to oppose each other are formed on portions surrounding the two side beam passage holes 100. The two side beam passage holes 100 are formed to be larger than the central beam passage hole 98. The eighth grid $GD_8$ is formed as a cylinder LCY8 to almost cover the seventh grid. The eighth grid $GD_8$ forms a large-aperture electron lens between itself and the seventh grid $GD_7$. The bulb spacer $B_S$ is arranged on the outer periphery of the distal end of the eighth grid $GD_8$. Since the bulb spacer $B_S$ is also in contact with the internal conductive film 70, it is applied with a positive high voltage from the anode terminal (not shown).

The cathodes K, and the control grid $G_1$ to the eighth grid $GD_8$ are supported by the insulating support member MFG. The deflection yoke 66 arranged to extend from the outer surface portion of the funnel section 58 to the outer surface portion of the neck section 60 has the horizontal and vertical deflection coils for deflecting the three electron beams $B_R$, $B_G$, and $B_B$ from the electron gun assembly 64 in the horizontal and vertical directions, respectively. In the electron gun assembly 64, all the electrodes except for the eighth grid $GD_8$ are applied with a predetermined external voltage through the stem pins STP.

In the electron gun assembly 64, a cutoff voltage of about 150 V is applied to the cathodes K, the control grid $G_1$ is used as a ground terminal, a voltage of 500 V to 1 kV is applied to the screen grid $G_2$, a voltage of 5 to 10 kV is applied to the first, third, fifth, and seventh grids $GD_1$, $GD_3$, $GD_5$, and $GD_7$, respectively, a voltage of 0 to 1 kV is applied to the second grid $GD_2$, a voltage of 0 to 3 kV is applied to the fourth grid $GD_4$, a voltage of 15 to 20 kV is applied to the sixth grid $GD_6$, and a voltage of 25 to 35 kV as an anode high voltage is applied to the eighth grid $GD_8$.

Figures 8A, 8B:
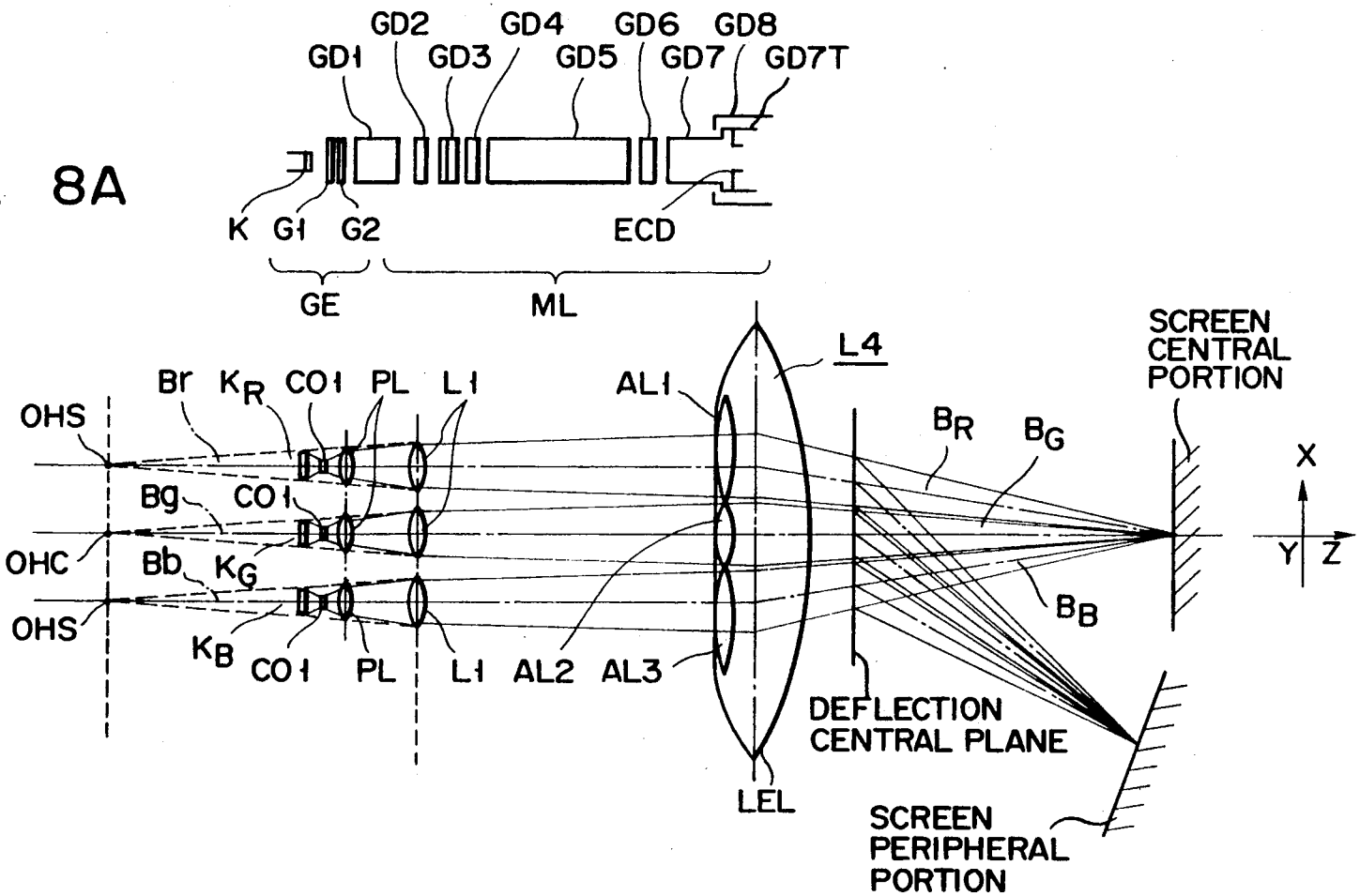
FIG. 8A is a view showing an electrode arrangement of the electron gun according to the present invention.
FIG. 8B shows an optically equivalent model in an X-Z direction of the electron gun according to the present invention.
Figure 8C:
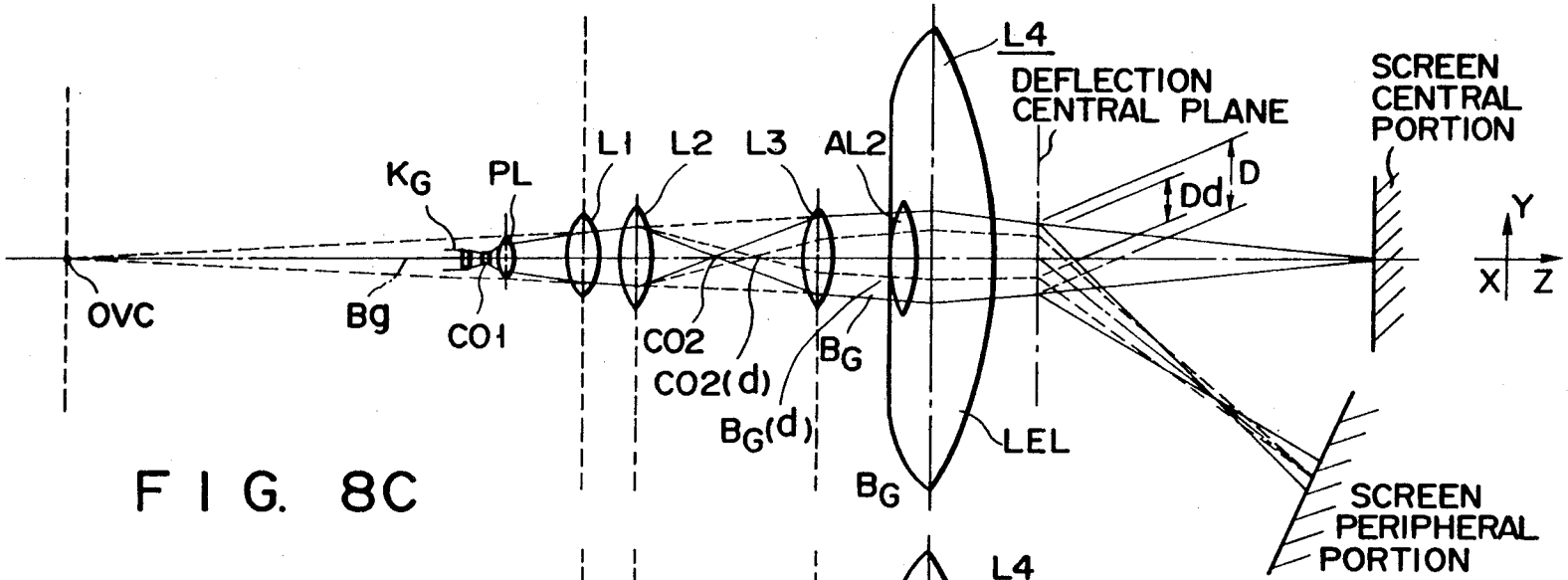
FIG. 8C shows an optically equivalent model in a Y-Z direction of a central electron beam of the electron gun according to the present invention.
Figure 8D:
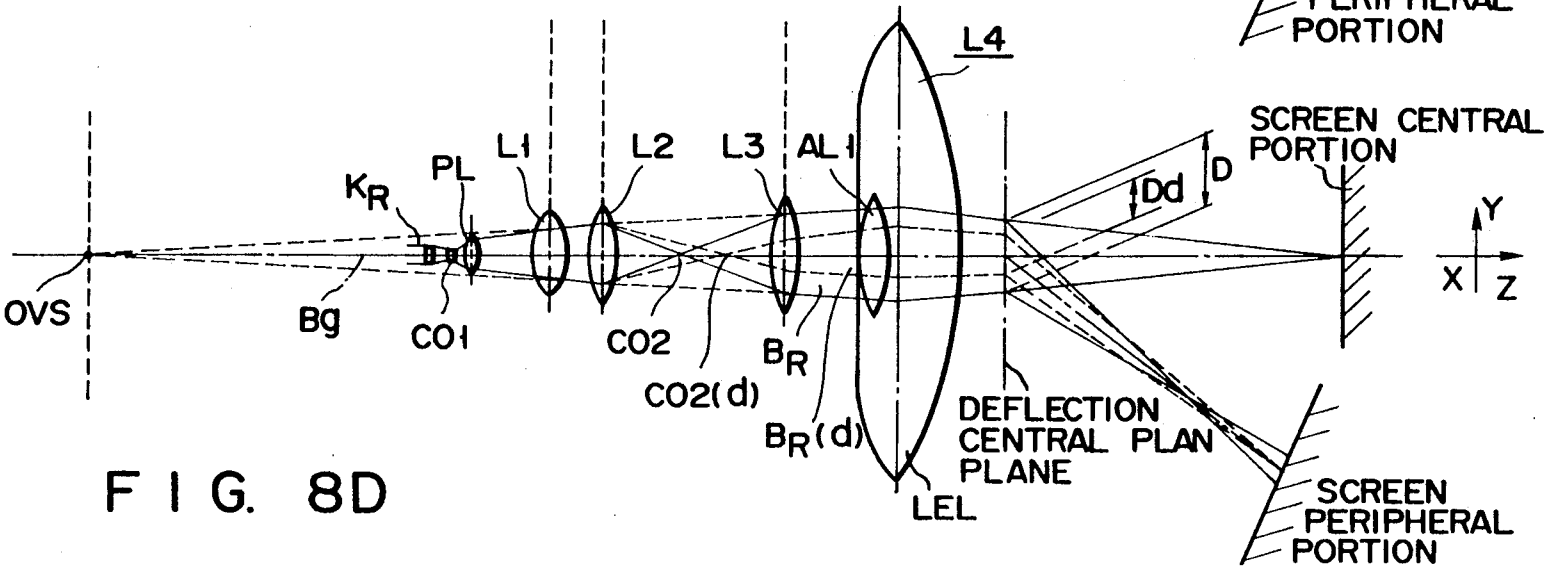
FIG. 8D shows an optically equivalent model in the Y-Z direction of a side electron beam of the electron gun according to the present invention.

FIGS. 8A to 8D show states of an electron lens. FIG. 8A shows an arrangement of the electrodes, FIG. 8B shows a horizontal section (X-Z section) of the electron lens, FIG. 8C shows a vertical section (Y-Z section) with respect to the central beam, FIG. 8D shows a vertical section with respect to side beams.

Beams generated from the cathodes K in accordance with corresponding modulation signals intersect on central axes Br, Bg, and Bb by the cathodes K, the control grid $G_1$, and the screen grid $G_2$, thus forming first crossovers $CO_1$. Divergence of the electron beams is slightly weakened by prefocus lenses PL defined by the screen grid Gz and the first grid $GD_1$, and the beams then become incident in the first grid $GD_1$ while being weakly diverged.

The electron beams $B_R$, $B_G$, and $B_B$ incident in the first grid $GD_1$ are focused by the main electron lens unit ML constituted by the first to eighth grids $GD_1$ to $GD_8$, and the two side beams $B_R$ and $B_B$ are also converged thereby. These electron beams $B_R$, $B_G$, and $B_B$ are deflected and scanned in the horizontal and vertical directions by the deflection yoke. Thus, the electron beams $B_R$, $B_G$ and $B_B$ are radiated on the phosphor screen, thus forming an image. In this case, since deflection defocusing occurs due to the magnetic fields of the deflection yoke, the main electron lens unit is dynamically changed to cancel the deflection defocusing.

The lens operation of the main electron lens unit constituted by the first to eighth grids $GD_1$ to $GD_8$ will be described in detail below.

The electron beams incident in the first grid $GD_1$ after they form the first crossovers $CO_1$ are formed as independent beams through the corresponding beam passage holes of the first, second, and third grids $GD_1$, $GD_2$, and $GD_3$. In this portion, independent unipotential lenses $L_1$ (first lenses) are formed. The three electron beams are slightly focused in the horizontal and vertical directions by these unipotential lenses $L_1$. The electron beams are focused slightly stronger in the vertical direction than in the horizontal direction by the upper and lower projections PJ formed on the third-grid side of the second grid $GD_2$. This is to decrease the beam spot size of the electron lens in a high current region.

Planar unipotential lenses $L_2$ (second lenses) defined by the beam passage holes formed in the third, fourth, and fifth grids $GD_3$, $GD_4$, and $GD_5$strongly focus three incident electron beams in only the vertical direction (Y direction). For this reason, the beams form second crossovers $CO_2$ as caustic curves in the X direction on a plane parallel to an X-Y plane in the intermediate portion of the fifth grid $GD_5$. After these second crossovers are formed, the electron beams are diverged.

Planar unipotential lenses $L_3$ (third lenses) defined by the corresponding beam passage holes formed in the fifth, sixth and seventh grids $GD_5$, $GD_6$, and $GD_7$ slightly focus the three electron beams in the vertical direction (Y direction). In this case, the central electron beam $B_G$ is focused slightly stronger than the side electron beams $B_R$ and $B_B$ by the grid having the shape shown in FIG. 6B. Thereafter, the three electron beams are incident on large-aperture electron lenses $L_4$ (fourth lenses (defined by the corresponding beam passage holes formed in the seventh and eighth grides $GD_7$ and $GD_8$. The large-aperture electron lenses $L_4$ focus and coverage the three electron beams in the horizontal and vertical directions. Therefore, the three electron beams form a small beam spot on the screen.

In the planar unipotential lenses $L_3$, the potential of the sixth grid $GD_6$ is preferably higher than those of the fifth and seventh grids $GD_5$ and $GD_7$ in view of the problems of aberrations. In the large-aperture electron lenses $L_4$, positions (assumed focusing positions) on the side of the cathodes K where the three electron beams incident on the lenses $L_4$ are assumed to be focused correspond to OHC (central beam) and OHS (side beams) in a direction of the horizontal plane (X-Z plane) shown in FIG. 8B, and correspond to OVC (central beam) and OVS (side beams) in a direction of the vertical plane (Y-Z plane) shown in FIGS. 8C and 8D. That is, in the direction of the horizontal plane (X-Z plane), the three electron beams are focused at equal positions. However, in the direction of the vertical plane (Y-Z plane), the position of the central beams is different from those of the side beams.

The assumed focusing positions are assumed by the strength of the lenses $L_4$ i.e. the potential of the grids by which the symmetrical electron beams are focused on the screen. That is, even if the potential of the seventh girds $GD_7$ by which the central beam is focused is different from the potential of the grids $GD_7$ by which the side beams are focused, the three electron beams can be assumed to be focused on the screen similarly, as the central beam and the side beams on the screen are small enough in practical use. Therefore, OHC and OHS are the same position in Z-direction in practical use, in shown in FIG. 8B. (In the embodiment described below, the difference between the potential of the seventh grids $GD_7$ by which the central beam is focused in horizontal, and its of the grids $GD_7$ by which the side beams are focused is about 100 V, but, the central beam and the side beams are focused on the screen similarly in practical use.)

Figure 9:
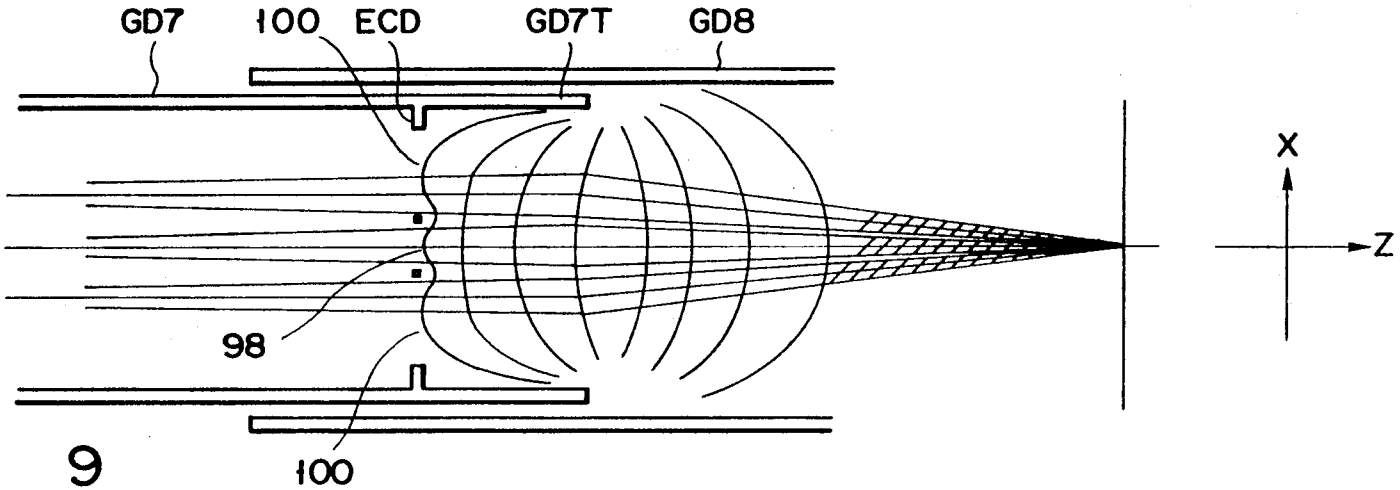
FIG. 9 is a sectional view taken along an X-Z direction of the main lens unit of the electron gun according to the present invention.
Figure 10:
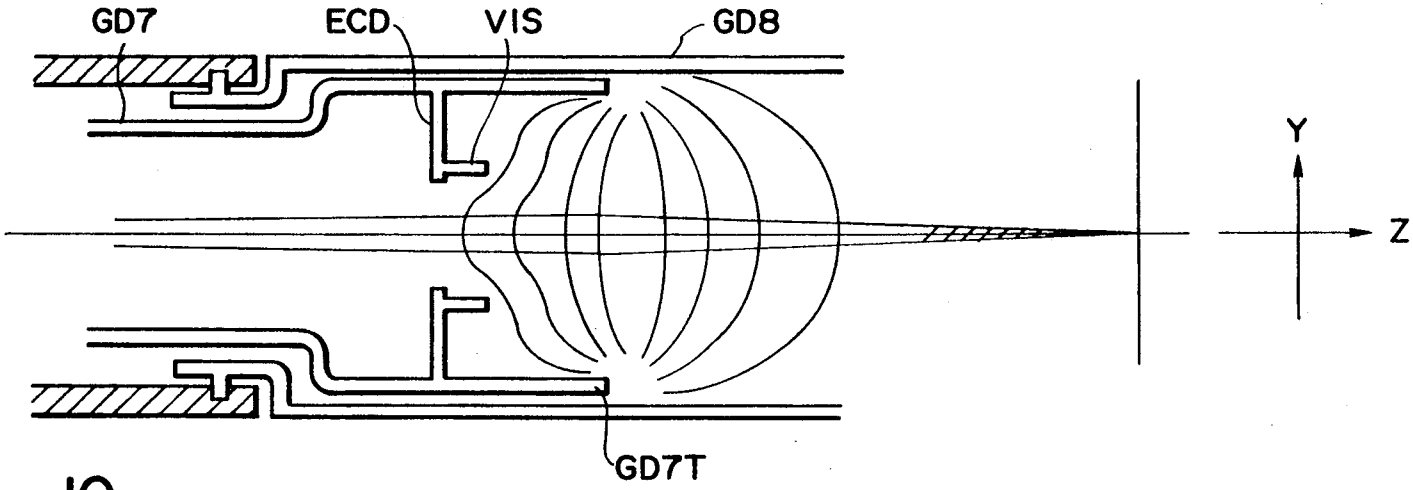
FIG. 10 is a sectional view taken along a Y-Z direction of the main lens unit of the electron gun according to the present invention.

In the large-aperture electron lenses $L_4$, diffusion of a high voltage from the side of the eighth grid $GD_8$ is controlled by the planar electrode ECD having the projections VIS shown in FIGS. 9 and 10. Thus, a distal end portion $GD_{7T}$ of the seventh grid $GD_7$ and the cylinder of the eighth grid $GD_8$ define a single large electron lens LEL, and three astigmatic lenses $AL_1$, $AL_2$, and $AL_3$ are formed in the lens region of this electron lens LEL. In these astigmatic lenses $AL_1$, $AL_2$, and $AL_3$, the side holes 100 are formed to be larger than the central hole 98, so that the side astigmatic lenses $AL_1$ and $AL_3$ have weaker focusing powers than that of the central astigmatic lens $AL_2$. More specifically, with this structure, a difference between focusing powers depending on positions of the electron beams caused by the electron lens LEL can be canceled. Each side beam is incident to be offset from the central position of the corresponding side hole 100 toward the central beam in the X-Z plane. For this reason, in the horizontal plane (X-Z plane), the side beams are influenced by a coma from the astigmatic lenses $AL_1$ and $AL_3$. However, this coma cancels that caused by the electron lens LEL. Therefore, since almost no coma of each side beam is generated, the beam spot of the electron beams can have a satisfactory shape.

In the fourth lenses $L_4$, horizontal focusing powers applied to the central beam and the two side beams coincide with each other according to the position of the planar electrode ECD, the shapes of holes, and design of projections, and vertical focusing powers of the two side beams are stronger than that of the central beam. The electron beams are focused stronger in the horizontal direction than in the vertical direction. For this reason, positions (assumed focusing positions) on the side of the cathodes K where the three electron beams are assumed to be focused correspond to OHC (central beam) and OHS (side beams) in the direction of the horizontal plane (X-Z plane) shown in FIG. 8B, and correspond to OVC (central beam) and OVS (side beams) in the direction of the vertical plane (Y-Z plane) shown in FIGS. 8C and 8D. More specifically, horizontal positions (assumed focusing positions) where the beams are assumed to be focused are separated by an equal distance from the fourth lenses $L_4$ for both the central beam and the two side beams. However, a vertical position (assumed focusing position) where the central beam is assumed to be focused is separated by a longer distance from the lens $L_4$ than the two side beams. And OHC is positioned the side of the fourth lens rather than OVC.

The vertical focusing can be easily strengthened rather than, or equal to the horizontal focusing, so that the planer electrode ECD can be changed in the positioning, the aperture form, and the shape of the projections. For example, if the diameter in Y-direction of the central beam passage hole 123 in the planar electrode ECD, shown in FIG. 7A becomes smaller, and the projections VIS become longer, so the vertical focusing can be strengthened rather than the horizontal focusing. In above case, OHC and OHS are the same position, but OVC is positioned far from the fourth lens L4 rather than OVS, and OVC is positioned the side of the fourth lens rather than OVS. That is, the focusing of the electron beams incident in the fourth lens $L_4$ is adjusted by the first to third lens $L_1$, $L_2$, $L_3$. Moreover, if the planar electrode ECD is adjusted, the focusing force of the central beam and of the side beams can be equal, or reverse. Thus, the electron beams are equally focused in all the directions on the screen.

The two side beams are deflected toward the central beam by the electron lens LEL and the astigmatic lenses $AL_1$ and $AL_3$, thus converging three beams on the screen. This state of the beam was clarified by three-dimensional electric field analysis using a computer and experiments conducted by the present inventors.

In the above embodiment, each first lens $L_1$ suppresses an excessive increase in divergence angle of an electron beam when an electron beam amount is increased (when the electron gun is driven by a high current). The first lens $L_1$ has a stronger vertical focusing power than a horizontal focusing power. Since many lenses, e.g., the second lenses $L_2$, the third lenses $L_3$, and the like are used in the vertical direction rather than in the horizontal direction, aberrations are added by the respective lenses in the electron beams in the vertical direction. Therefore, a spot shape of the electron beams on the screen is impaired in the vertical direction. For this reason, when the electron beams are focused stronger in the vertical direction than in the horizontal direction, the electron beams can be focused on the screen to have a substantially circular spot shape. A method of focusing the electron beams stronger in the vertical direction than in the horizontal direction may be attained by, e.g., forming elliptic beam passage holes, or by focusing the electron beams stronger in the vertical direction than in the horizontal direction in the beam forming unit in place of using the electrodes shown in FIG. 5.

The first lenses $L_1$ change states of the electron beams to vary the total length of the electron gun, so that magnifications and aberrations of all the electron lenses can be adjusted, and electrode potentials can be adjusted.

In the first lenses $L_1$, since the electron beams are focused stronger in the vertical direction, an overfocusing state is established. However, in this state, when the potential of the fourth grid $GD_4$ is increased (dynamic focus), the vertical focusing power is mainly weakened by the planar unipotential lenses $L_2$ defined by the corresponding beam passage holes formed in the third, fourth, and fifth grids $GD_3$, $GD_4$, and $GD_5$, and the second crossovers $CO_2$ on the horizontal plane are shifted toward the screen to the positions of second crossovers $CO_2(d)$. Therefore, a distance from each electron lens $L_4$ to a vertical convergence point is shortened. The electron beams focused on the screen are underfocused. As a result, the overfocusing state by the deflection yoke can be canceled, and the electron beams are appropriately focused at the screen position.

As shown in FIGS. 8A to 8D, when dynamic focusing is performed on the peripheral portion of the screen, a beam size on the deflection central plane is decreased from D to Dd, and the influence of deflection defocusing can be eliminated, resulting in a very high dynamic focusing sensitivity.

Figure 11:
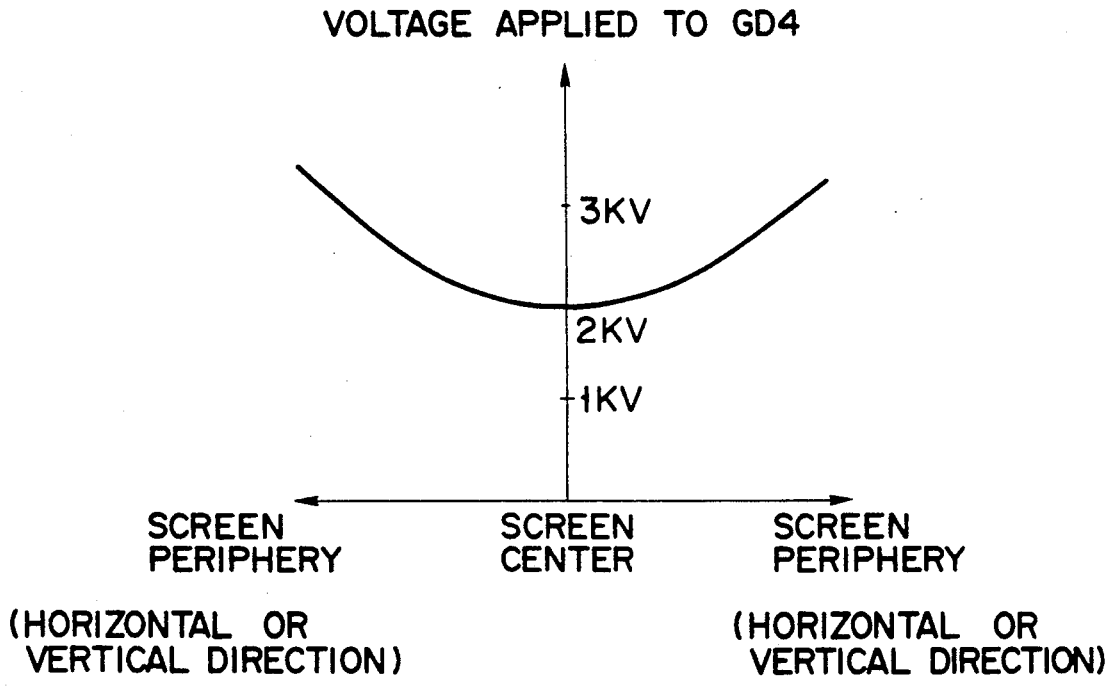
FIG. 11 is a graph showing the relationship between a position of an electron beam on a face plate and a dynamic deflection voltage.

When a horizontal or vertical deflection voltage shown in FIG. 11 is applied to the fourth grid $GD_4$ to deflect the above-mentioned electron beams, deflection defocusing caused by the deflection yoke can be eliminated. Therefore, the electron beams can have a good spot shape on the entire surface of the screen, and a color cathode ray tube apparatus having high resolution can be provided.

A dynamic voltage shown in FIG. 11 can provide an economic effect since it can reduce a load on a driver for applying a voltage as compared to a conventional dynamic voltage.

Actual specifications of the above-mentioned embodiment will be described below.

Neck inner diameter = 30.9 mm
Neck outer diameter = 37.5 mm
Cathode interval Sg = 4.92 mm
Hole diameters of electrodes $G_1 = G_2 = 0.62$ mm
Hole diameters of first, second, and fourth grids $GD_1$, $GD_2$, and $GD_4$ = 4.52 mm
Vertical/horizontal apertures of third, fourth, fifth, sixth, and seventh grids $GD_3$, $GD_4$, $GD_5$, $GD_6$, and $GD_7$ = 4.52 mm/15.0 mm (vertical/horizontal apertures of two side large hole portions = 8.0 mm/2.5 mm)
Vertical/horizontal apertures of planar electrode portion of seventh grid:
Central portion = 11.0/4.52 mm
Two end portions = 11.0/7.00 mm
Diameter of seventh grid $GD_7$ = 25.0 mm
Diameter of eighth grid $GD_8$ = 28.0 mm
Lengths of electrodes are:
first grid $GD_1$ = 2.5 mm,
second grid $GD_2$ = 2.0 mm,
third grid $GD_3$ = 9.2 mm,
fourth grid $GD_4$ = 8.8 mm,
fifth grid $GD_5$ = 17.0 mm,
sixth grid $GD_6$ = 4.4 mm,
seventh grid $GD_7$ = 37.0 mm, and
eighth grid $GD_8$ = 40.0 mm A screen diagonal effective length is 32", and a maximum diagonal deflection angle $\theta$ is 110°. Electrode potentials for appropriately focusing the beam spot on the screen central portion are:

first grid $GD_1$, third grid $GD_3$, fifth grid $GD_5$, and seventh grid $GD_7$ = about 9 kV,
second grid $GD_2$ = 0 V,
fourth grid $GD_4$ = about 2 kV,
sixth grid $GD_6$ = about 20 kV, and
eighth grid $GD_8$ = about 32 kV.

Figure 12A:
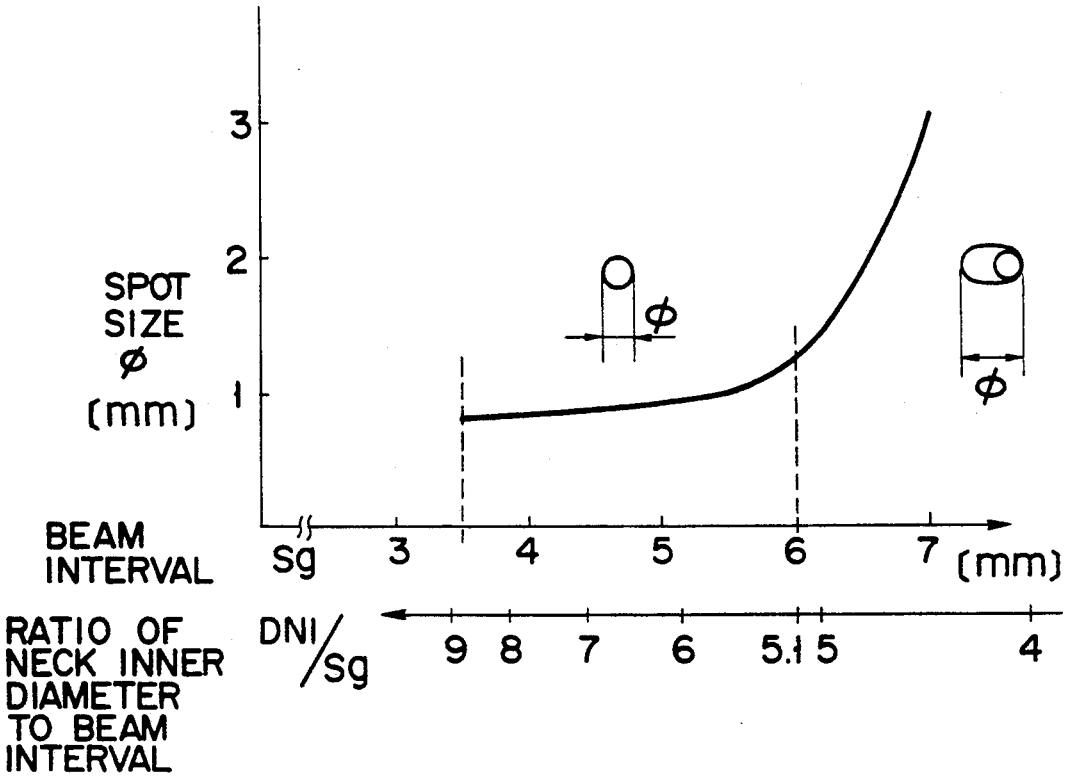
FIG. 12A is a graph in which a spot size of an electron beam is plotted along the ordinate, and an interval between electron beams or a ratio of a neck inner diameter to the beam interval is plotted along the abscissa.
Figure 12B:
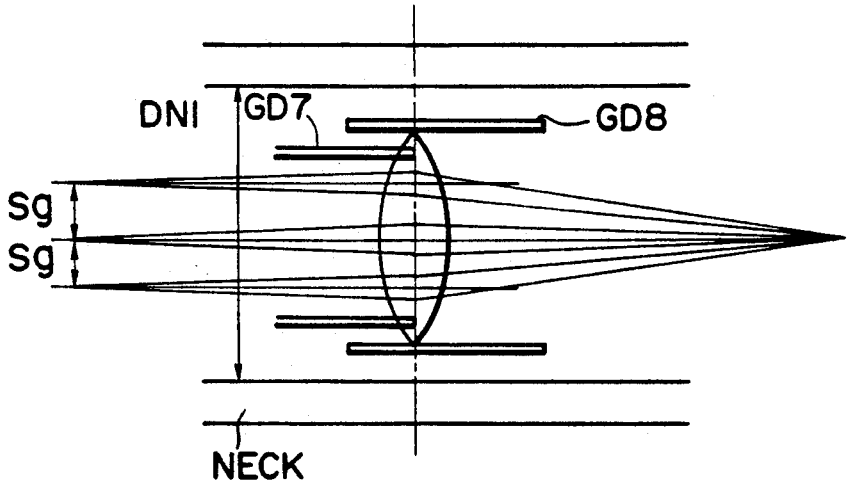
FIG. 12B is a sectional view of the main lens unit of an electron lens.

Thus, the three electron beams are converged at one point on the central portion of the screen, and the spot size is 0.9 mm (Ik = 1 mA). This value can sufficiently satisfy a resolution of an HDTV. This spot size is 12 mm or more as an equivalent lens aperture. Since the beam passage hole diameter of the seventh grid $GD_7$ is as large as 25 mm, if the interval Sg among three beams incident on the common large-aperture lens is too large, the electron gun cannot cancel aberration components of the lens LEL, aberrations remain in the two side beams, or three beams cannot be converged on one point. FIG. 12A shows beam sizes (including aberration components) of two side beams on the screen when the beam interval Sg is changed while the beam passage hole diameters of the seventh and eighth grids $GD_7$ and $GD_8$ are constant. As shown in FIG. 12A, when Sg exceeds 6 mm, aberration components are increased, and the beam size is abruptly increased. As shown in FIG. 12B, this phenomenon is associated with the beam interval Sg with respect to the lens aperture of the large-aperture electron lens defined by the seventh and eighth grids $GD_7$ and $GD_8$. The large-aperture electron lens is not limited to the seventh and eighth grids $GD_7$ and $GD_8$ of this embodiment, but may be increased in size, and the diameter of the eighth grid $GD_8$ can be theoretically increased up to the neck inner diameter in maximum. That is, in place of the beam interval Sg plotted along the abscissa in FIG. 12A, the abscissa can be expressed by a ratio of the neck inner diameter Di to Sg. As can be understood from FIG. 12A, an appropriate ratio Di/Sg is about 5.1 or more in a color cathode ray tube apparatus for an HDTV.

On the other hand, it is preferable that Sg is sufficiently small with respect to a lens aperture (beam passage hole diameter). However, the three cathodes must be independently arranged in the electron beam forming unit, and it is difficult to set an interval between three electron beams to be 3.5 mm or less in association with a divergence angle formed when the electron beams are diverged from the electron beam forming unit. Since the cathode diameter is about 3.0 mm, a holder for supporting the cathode has a thickness of 0.4 mm, and a divergence angle of a beam is 5° to 6° for a large current, when the three beams propagate from the beam forming unit by only about 20 mm, they overlap each other. For this reason, Sg has a limitation, and Sg can be widened to about 6.0 mm in relation to the neck inner diameter. Therefore, it is proper that Sg falls within a range of about 3.5 to 6.0 mm. Therefore, an upper limit of the ratio of the inner diameter to Sg preferably is about 8.8, as shown in FIG. 12A. Thus, this ratio preferably falls within a range of about 5.1 to 8.8.

Figure 13A:
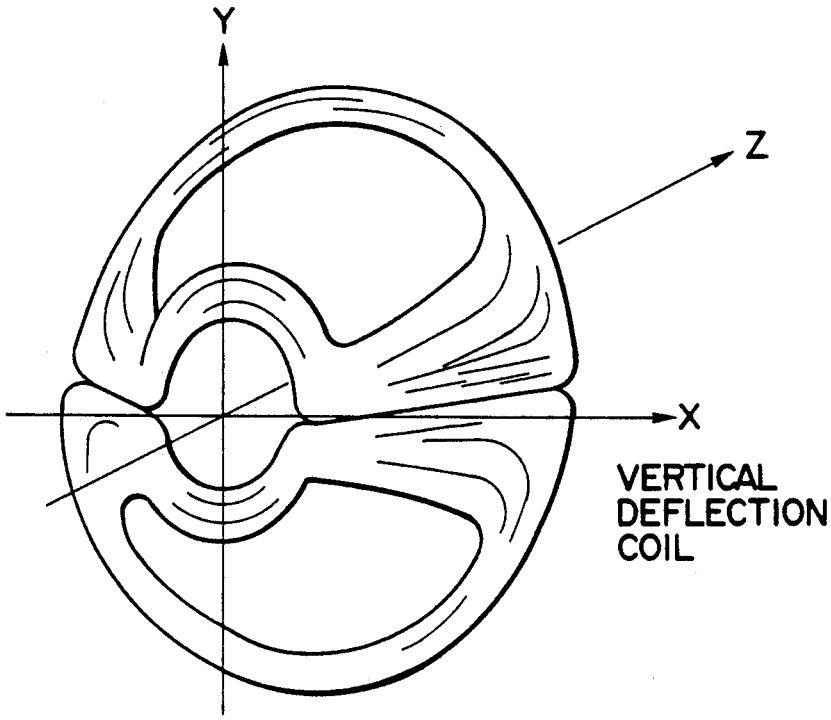
FIG. 13A is a perspective view of a horizontal deflection coil used in this apparatus.
Figure 13B:
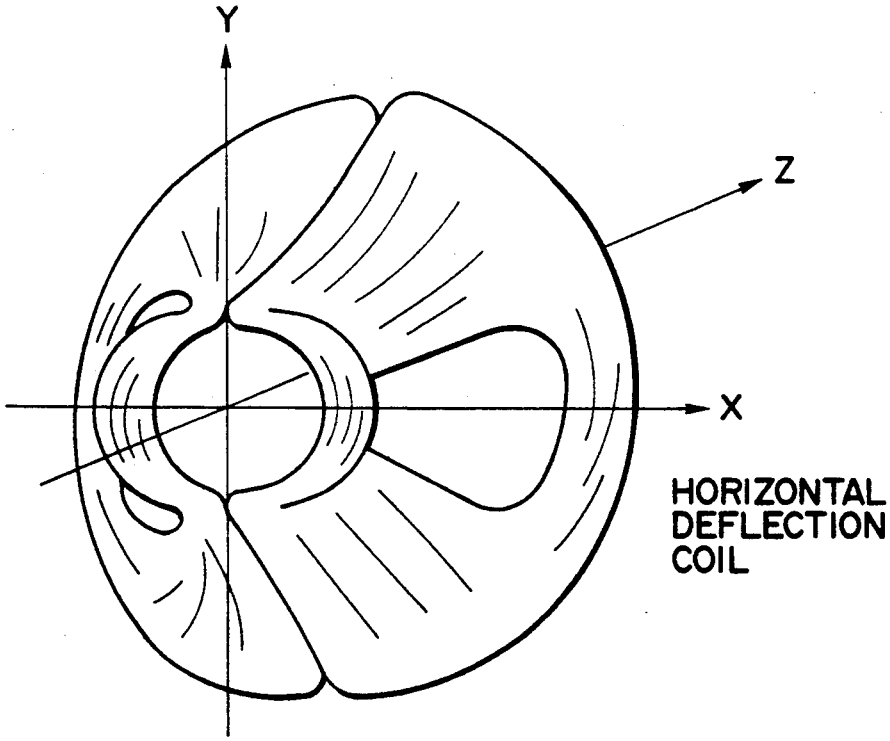
Fig. 13B is a perspective view of a vertical deflection coil used in this apparatus.
Figure 14A:
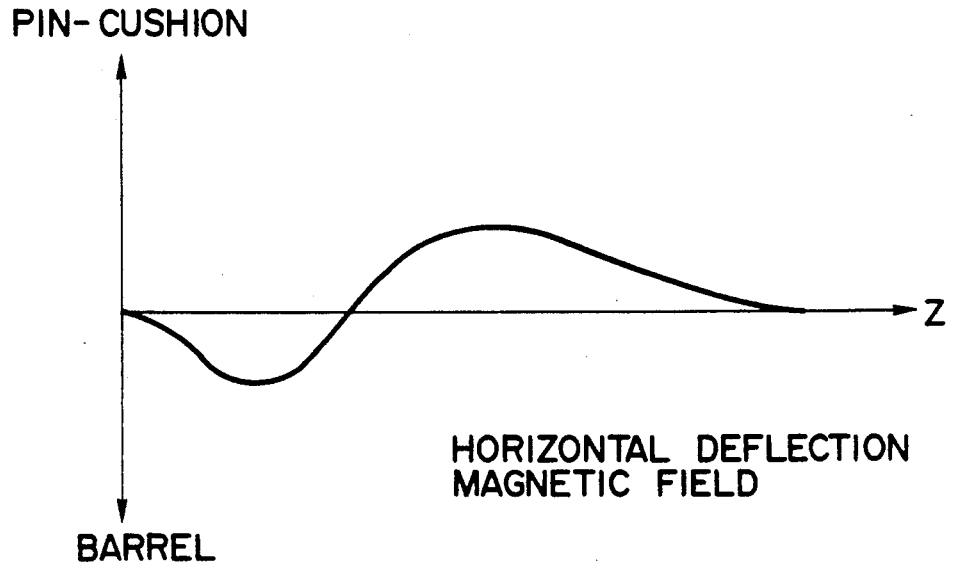
FIG. 14A is a chart showing a magnetic field distribution of the horizontal deflection coil shown in FIG. 13A.
Figure 14B:
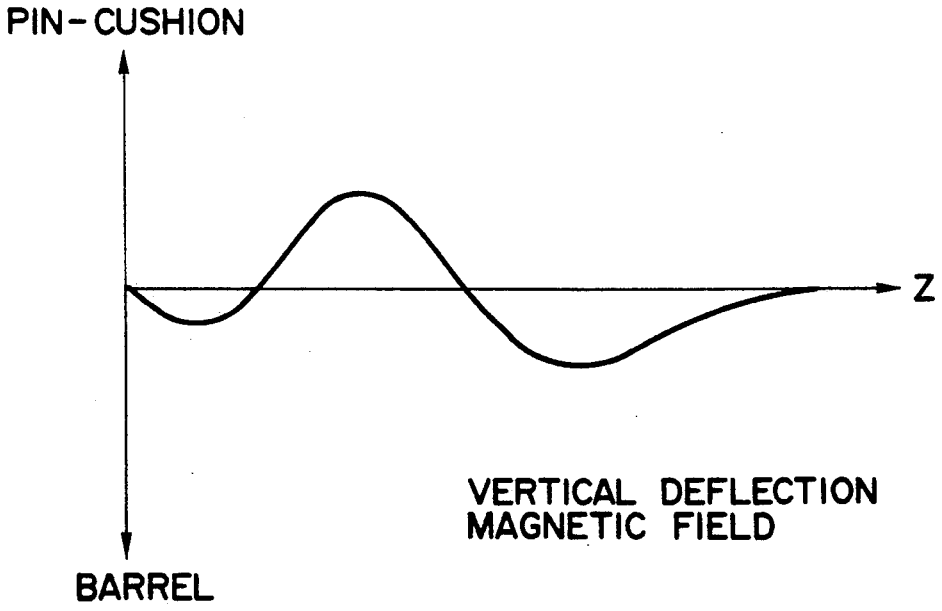
FIG. 14B is a chart showing a magnetic field distribution of the vertical defection coil shown in FIG. 13B.

FIGS. 13A and 13B show the deflection yoke according to the present invention. The horizontal deflection coil of the deflection yoke is molded to a saddle shape, and the vertical deflection coil also has a saddle shape. FIG. 14A shows a magnetic field generated by the horizontal deflection coil, and FIG. 14B shows a magnetic field generated by the vertical deflection coil. The magnetic fields generated by these two deflection coils are approximate to equal magnetic fields and provide small deflection defocusing to beams since degrees of pin-cushion and barrel are small. However, at the horizontal ends of the screen, the beam is overfocused in the vertical direction to easily cause a halo. Since this halo is dynamically corrected by the electron gun, high resolution can be maintained on the entire surface of the screen.

According to the present invention, although the interval Sg of the three electron beams is as small as 4.92 mm, the neck inner diameter is 37.5 mm, and good convergence of the electron beams can be assured.

Figure 15:
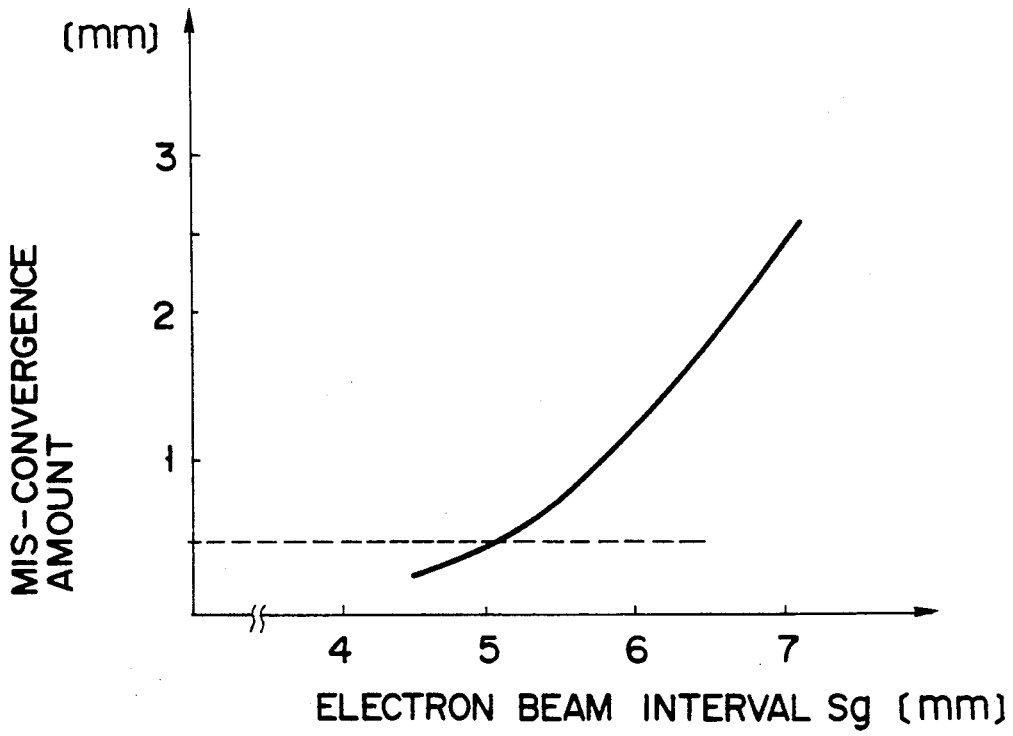
FIG. 15 is a graph showing the relationship between a mis-convergence amount and an electron beam interval.

According to the present invention, since the beam interval Sg is small relative to the neck diameter, mis-convergence can be minimized, and a mis-convergence amount of 0.3 to 0.5 mm can be satisfied. The graph of FIG. 15 illustrates this state. Therefore, a color cathode ray tube apparatus of the present invention can be satisfactorily applied to an EDTV and HDTV.

In order to finely adjust the deflection magnetic field distribution, in particular, the horizontal deflection coil has a saddle shape and adopts section winding, and the vertical deflection coil is molded into a saddle shape so as not to generate an unnecessary magnetic field to the electron gun.

The deflection yoke of this embodiment has a high deflection sensitivity since it is molded to be elongated in the direction of the tube axis. A deflection sensitivity can be increased when the neck diameter is small. According to the present invention, however, since the neck section is molded to have a large neck diameter to improve convergence, a deflection region is prolonged to improve the deflection sensitivity. Since the deflection yoke is molded to be elongated in the direction of the tube axis, it has a large surface area and heat generated by the deflection yoke can be easily radiated.

Figure 16:
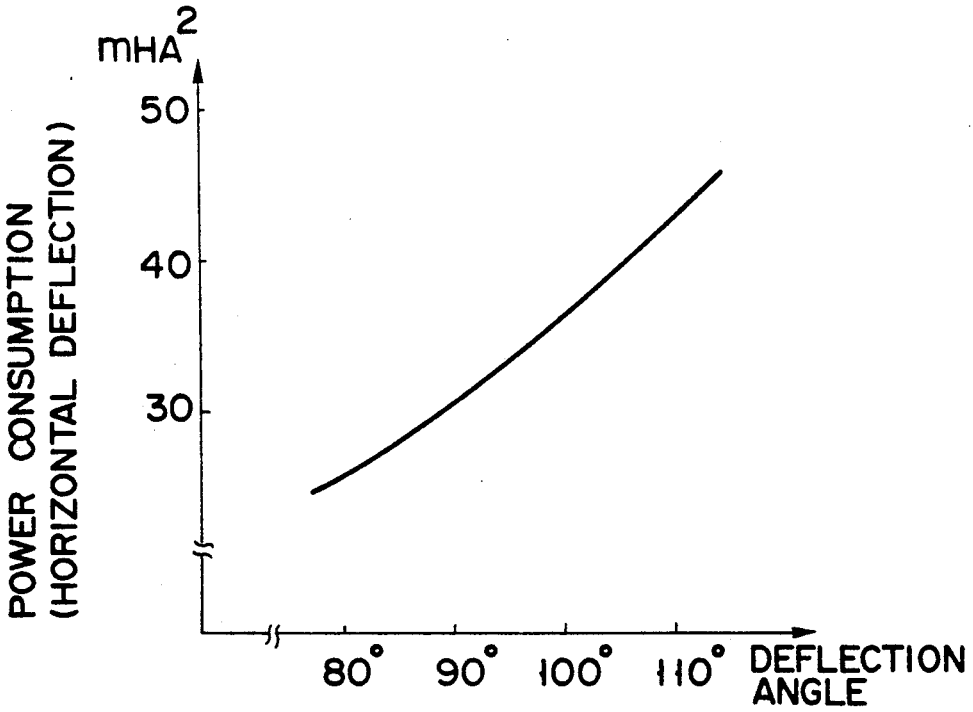
FIG. 16 is a graph showing the relationship between power consumption and a deflection angle of electron beams deflected by a deflection device.

In general, when a constant deflection frequency is applied to the deflection yoke, a deflection current $i_H$ is increased with an increase in deflection angle, and power consumption $L_H \cdot (i_H^2)$ is abruptly increased, as shown in FIG. 16. At the same time, heat generation of the deflection yoke is also abruptly increased.

If a deflection frequency is increased when the deflection yoke deflects the electron beams through a constant deflection angle, heat generation of the deflection yoke is increased. This is because an eddy current is generated by the coils of the deflection yoke when the frequency is increased. When a frequency is high, a coil wire is formed not by a single wire but by a strand of thin wires (litz wire). Thus, an eddy current loss caused by the high frequency can be prevented. For example, the litz wire is used in a deflection yoke of a color cathode ray tube for a computer display. However, the litz wire is expensive, and poses a problem in terms of cost when it is used in a home color cathode ray tube. In the present invention, such a problem does not occur at all.

Figure 17:
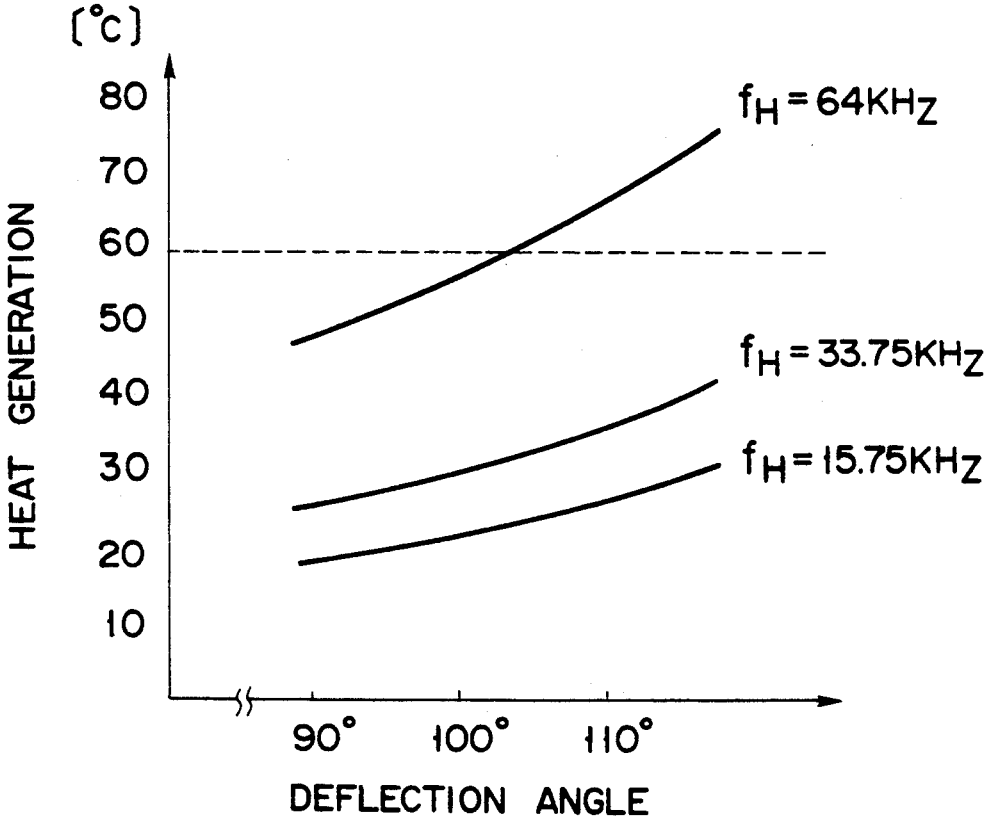
FIG. 17 is a graph showing the relationship between a heat generation temperature of the deflection device and a deflection angle of electron beams deflected by the deflection device.

EDTV and HDTV have various standards, and a horizontal deflection frequency may be a maximum of 64 kHz. FIG. 17 shows a heat generation state of the deflection yoke when the deflection yoke of the present invention is used at this deflection frequency. The temperature of the deflection yoke must be set below 60° C. according to a heat resistance of a material to be used. Therefore, in the color cathode ray tube apparatus of the present invention, the deflection yoke can be used up to 100° when the horizontal deflection frequency is 64 kHz. In an HDTV proposed by NHK (Japan Broadcasting Corporation), since a maximum horizontal deflection frequency is 33.75 kHz, the deflection angle can be set to be 110° or more. That is, the apparatus can be manufactured like in the conventional color cathode ray tube apparatus.

Since power consumption $L_H \cdot (i_H^2)$ of the deflection yoke is almost equal to that of the conventional color cathode ray tube, there is no increase in cost of the circuit associated with power consumption.

In the deflection yoke of the present invention, the length of the horizontal deflection coil in the direction of the tube axis is 110 mm, an opening on the side of the electron gun is about 40 mm, and an opening on the side of the screen is about 180 mm. Each coil of the deflection yoke is formed by winding a single wire, and its power consumption $L_H \cdot (i_H^2)$ is about 42 mH·(A$^2$) (anode voltage =32 kV). When a deflection current having a deflection frequency of 33.75 kHz flows through the deflection yoke, a temperature of the deflection yoke increased by its heat generation is about 40° C., thus posing no thermal problem.

When the deflection yoke and the electron gun of the present invention are used, a mis-convergence amount is about 0.5 mm, and a color cathode ray tube apparatus which can form a high-quality image can be provided.

The electron gun used in the present invention is not limited to one described in the above embodiment. However, various other electron guns may be used as long as they can converge and focus three in-line aligned electron beams by a common large-aperture electron lens. The grids $GD_2$ to $GD_6$ of the electron gun described in the above embodiment are not always required.

The dynamic focusing means for correcting deflection aberration is not limited to one described in the above embodiment. A conventional four-pole lens can be used for the correcting means.

The size of the color cathode ray tube apparatus of the present invention is not limited to 32", and color cathode ray tube apparatuses having various other sizes may be manufactured.

According to the present invention, in a color cathode ray tube apparatus required to have a high-quality image like in an EDTV or HDTV, a tube can be manufactured to have the same tube length as that of the conventional color cathode ray tube apparatus, and power consumption can be reduced as compared to a conventional color cathode ray tube apparatus for an EDTV or HDTV. Thus, a color cathode ray tube apparatus which has high practicability and high industrial and commercial merits can be provided.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode ray tube apparatus comprising:

an envelope having a panel, a funnel, and a neck;

a screen formed on an inner surface of said panel;

an electron gun, accommodated in said neck, for outputting a plurality of electron beams; and deflection means, arranged to extend from said neck to an outer surface of said funnel, for deflecting the electron beams in horizontal and vertical directions, wherein said deflection means comprises at least saddle-type horizontal and vertical deflection coils, the electron beams ar deflected by said deflection means to have a maximum diagonal deflection angle of not less than 100°, said electron gun comprises at least an electron beam forming unit having three cathodes, and a main electron lens unit for focusing and converging the electron beams, said electron beam forming unit outputs adjacent electron beams at an interval of 3.5 to 6.0 mm, a ratio of an inner diameter of said neck to the interval between the adjacent electron beams is not less than 5.1, and said main electron lens unit comprises a large-aperture electron lens formed by a substantially cylindrical first electrode for allowing three electron beams to pass therethrough, and a substantially cylindrical second electrode in which most of said first electrode is arranged.

2. An apparatus according to claim 1, wherein said main electron lens unit of said electron gun has three independent electron beam passage holes, and at least one electrode has a front and rear face, and two projections projecting on one of the front and rear face, the two projections being on opposite sides of the three electron beams and parallel to an alignment plane of the three electron beams.

3. An apparatus according to claim 1, wherein said main electron lens unit of said electron gun comprises at least one electrode which has a passage hole common to the three electron beams, a front and rear face, and two projections projecting on one of the front and rear face, the two projections being on opposite sides of the three electron beams and parallel to an alignment plane of the three electron beams.

4. An apparatus according to claim 3, wherein a portion of each of the two projections near a central beam of the three electron beams projects longer than portions near two side beams.

5. An apparatus according to claim 1, wherein the first electrode has a front and rear face, and a plurality of projections projecting on one of the front and rear face, the projection being on opposite sides of side beams of the three electron beams and parallel to an alignment plane of the three electron beams.

6. An apparatus according to claim 1, wherein the first electrode has three passage holes, two of the three passage holes correspond to two side beams of the three electron beams, and one of the three passage holes corresponds to a central beam of the three electron beams and is smaller than the two passage holes corresponding to two side beams.

7. An apparatus according to claim 1, wherein said electron gun comprises a plurality of electrodes, and wherein a voltage applied to at least one of the electrodes of said electron gun is dynamically changed according to a deflection position of the three electron beams.

8. An apparatus according to claim 1, wherein three astigmatic lenses corresponding to the three electron beams are formed by said first electrode.

* * * * *